US007128403B2

(12) United States Patent
Jung

(10) Patent No.: US 7,128,403 B2
(45) Date of Patent: Oct. 31, 2006

(54) MICROACTUATOR AND FLUID TRANSFER APPARATUS USING THE SAME

(75) Inventor: Myung-song Jung, Gyeonggi-do (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 212 days.

(21) Appl. No.: 10/862,317

(22) Filed: Jun. 8, 2004

(65) Prior Publication Data

US 2004/0252164 A1 Dec. 16, 2004

(30) Foreign Application Priority Data

Jun. 10, 2003 (KR) ..... 10-2003-0037134

(51) Int. Cl.
*B41J 2/045* (2006.01)

(52) U.S. Cl. ..... 347/68

(58) Field of Classification Search ..... 347/68–72, 347/54, 9, 40, 44, 20; 400/124.14, 124.15, 400/124.16

See application file for complete search history.

(56) References Cited

U.S. PATENT DOCUMENTS 4,383,264 A * 5/1983 Lewis ..... 347/68
5,894,316 A 4/1999 Sakai et al.
6,123,414 A 9/2000 Choi
6,460,972 B1 10/2002 Trauernicht et al.
6,527,372 B1 * 3/2003 Choi et al. ..... 347/54
7,001,011 B1 * 2/2006 Silverbrook ..... 347/54

FOREIGN PATENT DOCUMENTS

| | | |
|---|---|---|
| JP | 6091865 | 4/1994 |
| JP | 2000326507 | 11/2000 |
| JP | 2000343692 | 12/2000 |
| KR | 2001-0012052 | 2/2001 |

* cited by examiner

*Primary Examiner*—K. Feggins
(74) *Attorney, Agent, or Firm*—Staas & Halsey LLP

(57) ABSTRACT

A microactuator using a shape memory alloy includes a substrate in which a space portion is formed, and a vibration plate which is installed on an upper surface of the substrate to cover the space portion, including a thin film formed of the shape memory alloy and at least one thin film on which a compressive residual stress acts. The vibration plate is initially transformed to bend to the space portion or to bend to be opposite to the space portion due to a bending moment caused by a compressive residual stress with respect to a first neutral axis, when the shape memory alloy is phase-transformed due to temperature rise.

22 Claims, 8 Drawing Sheets

MICROACTUATOR AND FLUID TRANSFER APPARATUS USING THE SAME

CROSS-REFERENCE TO RELATED APPLICATIONS

This application claims the priority of Korean Patent Application No. 2003-37134, filed on Jun. 10, 2003, in the Korean Intellectual Property Office, the disclosure of which is incorporated herein in its entirety by reference.

BACKGROUND OF THE INVENTION

1. Field of the Invention

The present invention relates to a microactuator, and more particularly, to a microactuator using shape memory alloy.

2. Description of the Related Art

In general, an ink-jet printhead is a device which prints an image having a predetermined color by ejecting minor ink droplets at a desired position of a sheet of paper. Widely available printheads generally utilize a drop on demand (DOD) system for ejecting minor ink droplets onto the sheet of paper only in case of need.

Ink ejection methods for an ink-jet printhead using the DOD system include a heat-type ejection method of ejecting ink by generating bubbles in ink using a heat source, a vibration-type ejection method of ejecting ink due to the variation in volume of ink caused by the deformation of a piezoelectric body using the piezoelectric body, and an ejection method using a shape memory alloy of ejecting ink due to the variation in the volume of ink caused by the return to its original shape stored using the shape memory alloy.

In the heat-type ejection method, as a considerably large electric energy is supplied to a heater that supplies heat to a chamber of a printhead within a very short time period, heat generated by the specific resistance of the heater is used. Heat generated from the heater is transferred to ink, and the temperature of the water-soluble ink increases rapidly and exceeds a temperature that is a critical point. In this case, bubbles are generated in the ink, and due to the bubbles, pressure is applied to ambient ink, and simultaneously, ink is pushed by the volume of the bubbles. Ink to which a kinetic energy is applied due to the pressure and the variation in volume is ejected to the outside through a nozzle. The ejected ink forms ink droplets and is ejected to the target to minimize the surface energy of the ink.

In the heat-type ejection method, due to the consecutive shock caused by the pressure occurring when bubbles generated by a thermal energy break, there is a problem with durability, and it is difficult to adjust the size of ink droplets.

In the vibration-type ejection method, a voltage is applied to a diaphragm by attaching a piezoelectric material to the diaphragm so that a pressure is applied to a chamber of a printhead. The pressure is applied to the chamber of the printhead using a piezoelectric characteristic, thus ejecting ink.

Since an ink-jet printhead using the vibration-type ejection method uses a high-priced piezoelectric device, it is costly. The piezoelectric device is required to harmonize with an electrode, an insulating layer, and a protective layer. Thus, a manufacturing process thereof is difficult, and a yield thereof is low.

FIGS. 1A and 1B are cross-sectional views illustrating the operation of a conventional microactuator for an ink-jet printhead using a shape memory alloy disclosed in U.S. Pat. No. 6,123,414.

Referring to FIGS. 1A and 1B, a space portion 11 is provided to the front and rear sides of a substrate 10 while penetrating therethrough in the up and down direction, and a vibration plate 12 in which a silicon thin film 12*b* and a shape memory alloy 12*a* are sequentially stacked to cover the space portion 11 is installed on an upper surface of the substrate 10. An electrode 21*a* for applying current to both sides of the vibration plate 12 is installed to contact the vibration plate 12. A nozzle plate 18, in which a nozzle 19 through which ink droplets 20 are ejected is formed, is installed on the substrate 10, and a passage plate 13 in which a chamber 14 in which ink is stored is disposed between the substrate 10 and the nozzle plate 18. A passage 16 for providing a path through which ink flows into the chamber 14 is provided to the passage plate 13.

In a microactuator for an ink-jet printer having the above structure, the vibration plate 12 bends to the space portion 11 due to a residual stress of the silicon thin film 12*b*. Thus, the shape memory alloy 12*a* stacked on the vibration plate 12 also bends to the space portion 11, together with the silicon thin film 12*b*. If current is applied to the shape memory alloy 12*a* through the electrode 21*a*, the shape memory alloy 12*a* generates heat by its own resistance, raising the temperature and transforming the phase from a martensite phase to an austenite phase to be flattened.

In this case, if the temperature of the shape memory alloy 12*a* increases, the mechanical elasticity coefficient of the shape memory alloy 12*a* is increased, and the amount of elongation is increased. If the temperature of the shape memory alloy 12*a* decreases, the mechanical elasticity coefficient of the shape memory alloy 12*a* is decreased, and the amount of elongation is decreased. By repeating the above operation, the volume of the chamber 14 is varied by a displacement amount of the vibration plate 12, and the ink droplets 20 are ejected to a sheet of paper through the nozzle 19 by their kinetic energy.

In the microactuator for an ink-jet printer having the above structure, the vibration plate is comprised of a double layer, such as a silicon thin film and a shape memory alloy. Thus, it is difficult to grasp the distribution of a residual stress existing in the silicon thin film exactly, since it is difficult to grasp whether the vibration plate 12 bends to the space portion or the chamber 14 during a cooling operation according to the width and thickness of the vibration plate 12 contacting the space portion 11.

In the microactuator for an ink-jet printer having the above structure, the vibration plate of the microactuator should bend to the space portion or the chamber when required, or the width of the vibration plate should be small. It is difficult to grasp the distribution of a residual stress existing in the silicon thin film and the operating characteristic of the shape memory alloy, such that the vibration plate cannot be transformed in a desired direction. Thus, a desired function of the microactuator is not obtained, and the structural design and operating control of the microactuator is not performed precisely.

SUMMARY OF THE INVENTION

The present invention provides a microactuator for an ink-jet printhead, the microactuator having a desired structure and controlling a desired operation when required.

According to an aspect of the present invention, a microactuator using a shape memory alloy comprises a substrate in which a space portion is formed and a vibration plate which is installed on an upper surface of the substrate to cover the space portion, further including a thin film formed of the shape memory alloy and at least one thin film on which a compressive residual stress acts, wherein the vibration plate is initially transformed to bend to the space portion or to bend to be opposite to the space portion due to a bending moment caused by the compressive residual stress with respect to a first neutral axis when the shape memory alloy is phase-transformed due to temperature rise. The vibration plate is transformed to bend to the space portion or to bend to be opposite to the space portion due to a bending moment occurring with respect to a second neutral axis that moves from the first neutral axis, and the vibration plate varies the area of a chamber in which fluid is stored, thus providing pressure to the fluid.

According to another aspect of the present invention, a fluid transfer apparatus comprises a substrate in which a space portion is formed, a passage plate wherein a chamber is installed on the substrate and in which fluid is temporarily stored, wherein a supply hole through which fluid is supplied to the chamber is provided at one side of the passage plate and an exhaust hole through which fluid is exhausted from the chamber is provided at the other side of the passage plate, and a vibration plate between the substrate and the passage plate. The vibration plate generates a pressure required to transfer fluid by varying the volume of the chamber, is installed on an upper surface of the substrate to cover the space portion and includes a thin film formed of shape memory alloy and at least one thin film on which a compressive residual stress acts. The vibration plate is initially transformed to bend to the space portion or to bend to be opposite to the space portion due to a bending moment caused by the compressive residual stress with respect to a first neutral axis, and when the shape memory alloy is phase-transformed due to a temperature rise, the vibration plate is transformed to bend to the space portion or to bend to be opposite to the space portion due to a bending moment occurring with respect to a second neutral axis that moves from the first neutral axis. The vibration plate varies the area of a chamber in which fluid is stored, thus providing pressure to the fluid, wherein a first valve which regulates fluid to flow only into the chamber, is installed in the supply hole, and a second valve which regulates fluid to flow only from the chamber into the exhaust hole, is installed in the exhaust hole.

Additional aspects and/or advantages of the invention will be set forth in part in the description which follows and, in part, will be obvious from the description, or may be learned by practice of the invention.

BRIEF DESCRIPTION OF THE DRAWINGS

The above and/or other aspects and advantages of the present invention will become more apparent by describing in detail preferred embodiments thereof with reference to the attached drawings in which.

DETAILED DESCRIPTION OF THE PREFERRED EMBODIMENTS

Figure 1A:
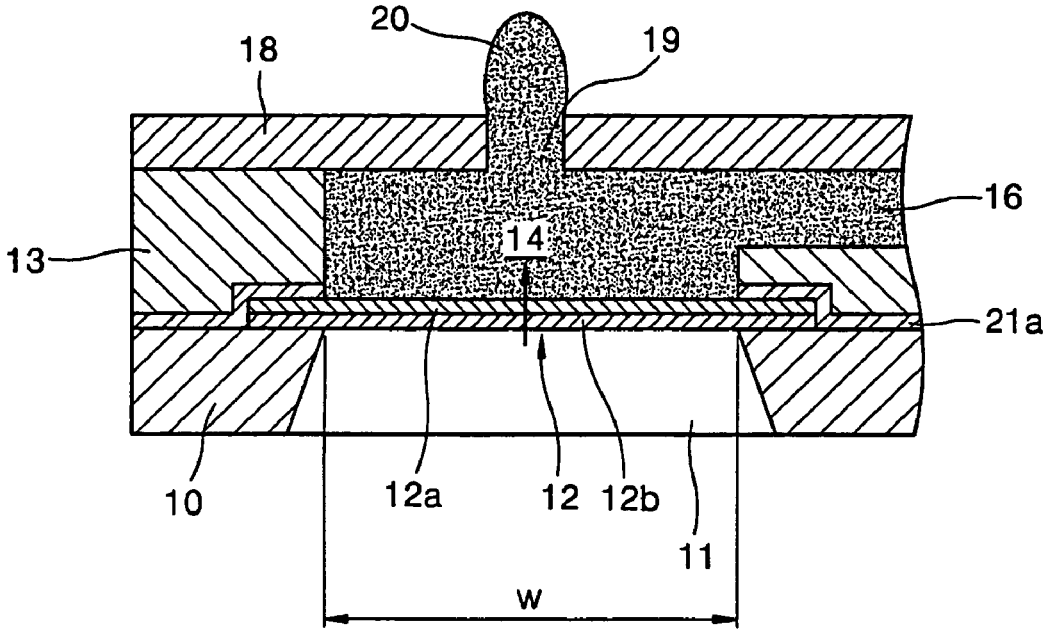
FIG. 1A (PRIOR ART)
FIGS. 1A and 1B are cross-sectional views illustrating the operation of a conventional microactuator for an ink-jet printhead using a shape memory alloy disclosed in U.S. Pat. No. 6,123,414.
Figure 1B:
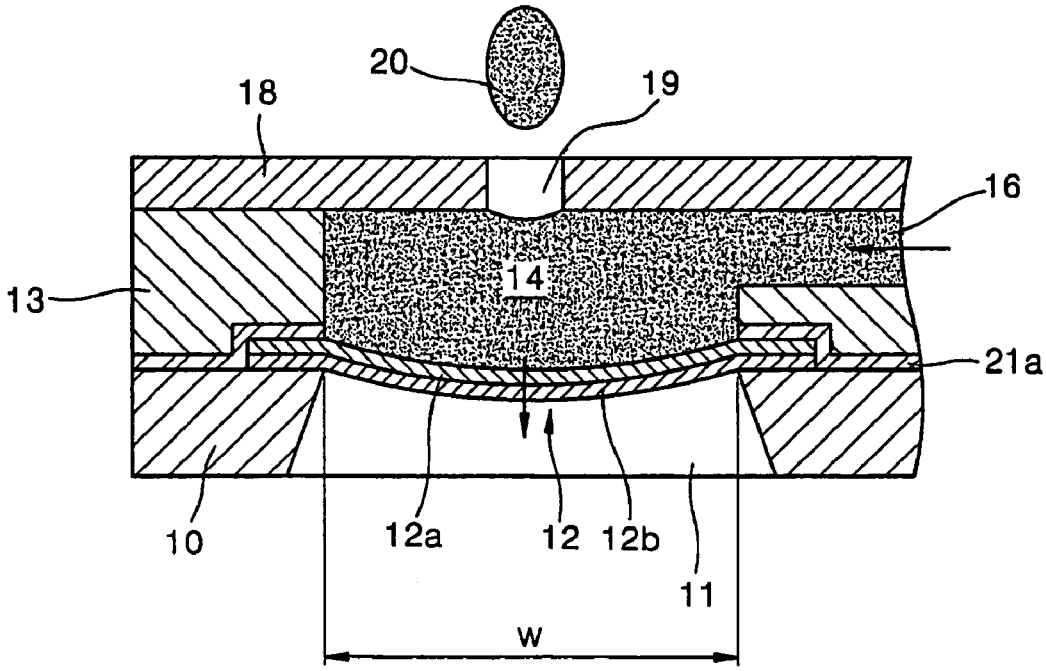
FIG. 1B (PRIOR ART)

Reference will now be made in detail to the embodiments of the present invention, examples of which are illustrated in the accompanying drawings, wherein like reference numerals refer to the like elements throughout. The embodiments are described below to explain the present invention by referring to the figures.

Figure 2:
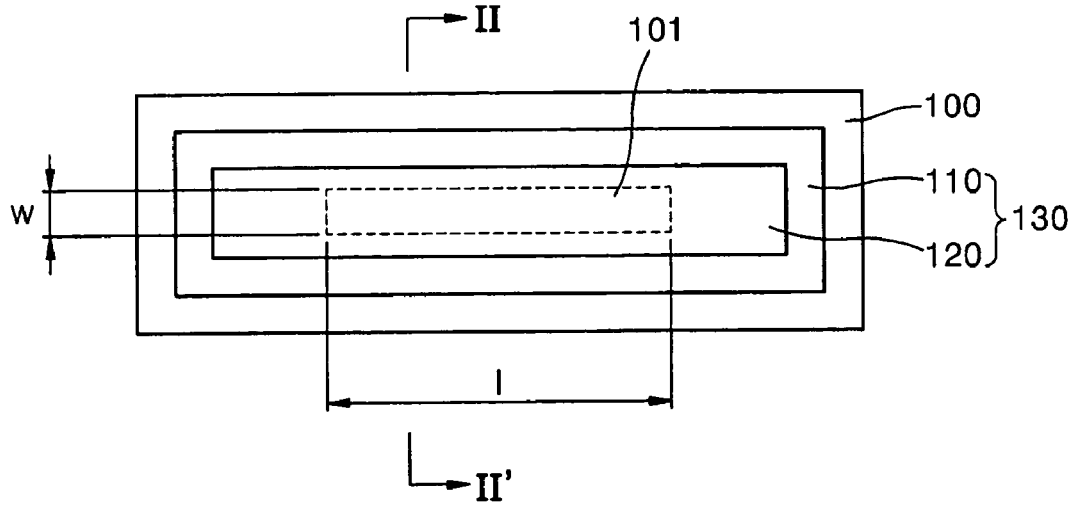
FIG. 2 is a plan view of a microactuator using a shape memory alloy according to an embodiment of the present invention.
Figure 3:
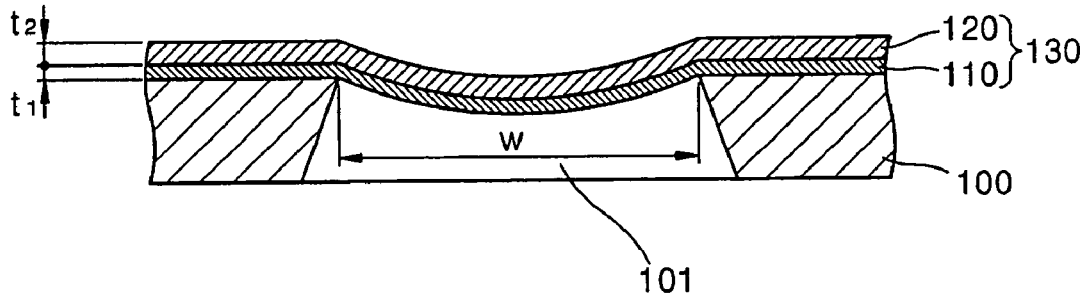
FIG. 3 is a cross-sectional view of an example in which a vibration plate is transformed to a space portion along line II–II' of the microactuator shown in FIG. 2.
Figure 4:
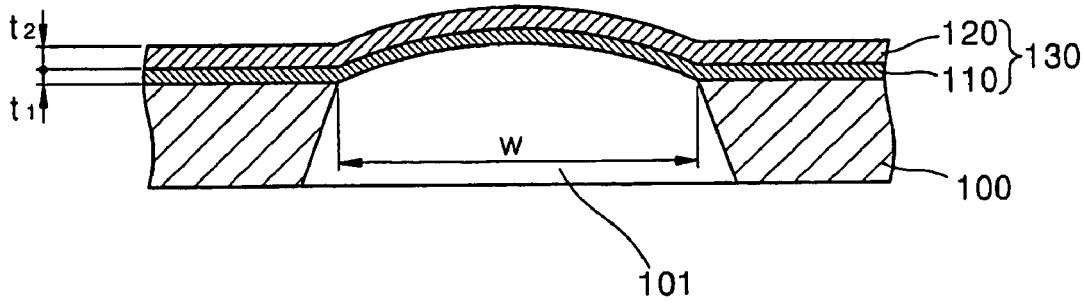
FIG. 4 is a cross-sectional view of an example in which a vibration plate is transformed to be opposite to a space portion along line II–II' of the microactuator shown in FIG. 2.

FIG. 2 is a plan view of a microactuator using a shape memory alloy according to an embodiment of the present invention, FIG. 3 is a cross-sectional view of an example in which a vibration plate is transformed to a space portion along line II–II' of the microactuator shown in FIG. 2, and FIG. 4 is a cross-sectional view of an example in which a vibration plate is transformed to be opposite to a space portion along line II–II' of the microactuator shown in FIG. 2.

Referring to FIG. 2, the microactuator using the shape memory alloy includes a substrate 100 in which a space portion 101 is formed, and a vibration plate 130 comprising a first thin film 110 formed of a silicon substrate ($SiO_2$) to cover an upper portion of the space portion 101, wherein a second thin film 120 is formed on an upper surface of the first thin film 110 and is formed of a shape memory alloy layer having a phase that is transformed according to a temperature variation.

In FIG. 2, the area of the substrate 100, wherein the first thin film 110 is layered on the substrate 100 and the second thin film 120 is layered on the first thin layer 110, is sequentially reduced for explanatory convenience. Thus, in actuality, as shown in FIGS. 3 and 4, an upper surface of the substrate 100 is covered by the first thin film 110, and the upper surface of the first thin film 110 is covered by the second thin film 120.

In FIG. 2, the vibration plate 130 includes a first thin film 110 and a second thin film 120 formed of the shape memory alloy. However, the first thin film 110 may be at least one thin film.

Referring to FIG. 3, the vibration plate 130 is installed to bend to the space portion 101. Referring to FIG. 4, the vibration plate 130 is installed to bend to be opposite to the space portion 101. This is defined by the relation between a residual stress existing in the first thin film 110 according to the width w and length l of the vibration plate 130 and the thickness $t_1$ of the first thin film 110, and the thickness $t_2$ Of the second thin film 120 contacting the upper portion of the space portion 101 before the vibration plate 130 is heated.

An initial transformation direction of the vibration plate 130 may be predicted by a purely theoretical model. However, in actuality, the initial transformation direction of the vibration plate 130 is inconsistent with the theoretical model due to the effect of a thin film manufacturing process or internal defects, and thus may be measured experimentally.

TABLE 1

| Width w of vibration plate | Thickness $t_2$ of second thin film 1.5 μm | 2.1 μm | 2.3 μm | Remarks |
|---|---|---|---|---|
| 69 μm | Concave | Convex | convex | |
| 75 μm | Concave | Concave | convex | |
| 78 μm | Concave | Concave | convex | |
| 85 μm | Concave | — | — | Wrinkle occurs |
| 110 μm | Concave | — | — | Wrinkle occurs |

Table 1 shows measurement results of an initial transformation direction of the vibration plate 130 according to the thickness $t_2$ of the second thin film 120 and the width w of the vibration plate 130 when the thickness $t_1$ of the first thin film 110 is fixed to 1 μm.

Referring to Table 1, when the width w of the vibration plate 130 is less than 85 μm and the thickness $t_2$ of the second thin film 120 is equal to or less than 2.1 μm, as shown in FIG. 3, the vibration plate 130 is transformed to bend to the space portion 101 and exhibits a concave shape.

When the width w of the vibration plate 130 is less than 85 μm and the thickness $t_2$ of the second thin film 120 is greater than 2.1 μm, as shown in FIG. 4, the vibration plate 130 is transformed to bend to be opposite to the space portion 101 and exhibits a convex shape.

Meanwhile, when the width w of the vibration plate 130 is equal to or greater than 85 μm, a residual stress existing in the first thin film 110 is distributed uniformly along the direction of the width w of the vibration plate 130, causing a wrinkle. Thus, it becomes difficult to cause the vibration plate 130 to be transformed to bend to the space portion 101 or be transformed to bend to be opposite to the space portion 101 in a concave or convex shape, and the vibration plate 130 cannot be transformed to bend in a desired direction. In addition, the width w of the vibration plate 130 should be selected so that the wrinkle due to the nonuniform distribution of a residual stress does not occur in the first thin film 110.

When the length of the vibration plate 130 contacting the top surface of the space portion 101 is l, generally the ratio of the width w to the length l of the vibration plate 130 is greater than approximately 1:3.

The operation of the microactuator using the shape memory alloy having the above structure according to an embodiment of the present invention will be described with reference to the drawings.

Figure 5:
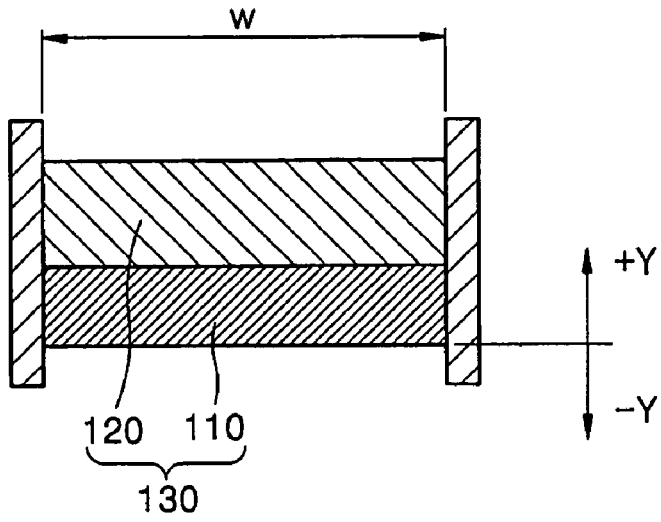
FIG. 5 illustrates the relationship between stress and transformation of the microactuator according to an embodiment of the present invention.
Figure 6:
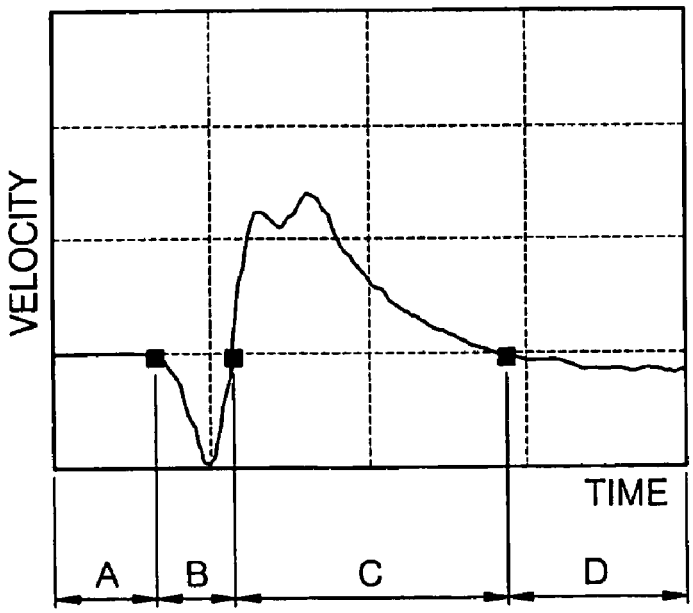
FIG. 6 is a graphical representation of the transformation direction versus the transformation amount according to the time of the microactuator shown in FIG. 3.
Figure 7:
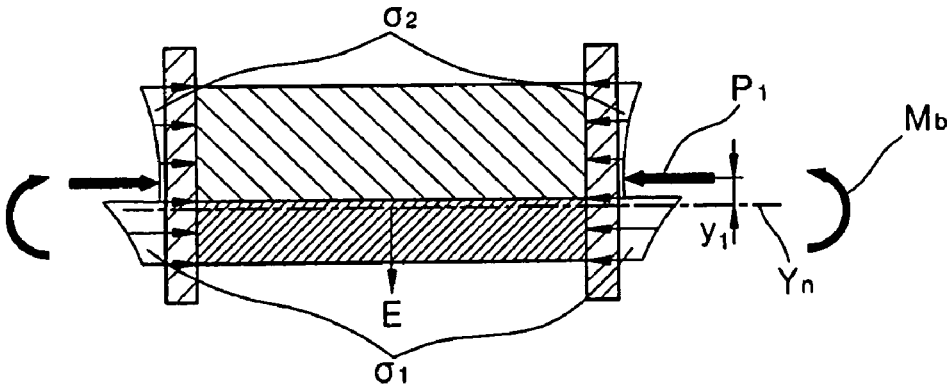
FIGS. 7 through 9 illustrate the relationship between the stress and the bending moment of the microactuator according to each time period shown in FIG. 6.
Figure 8:
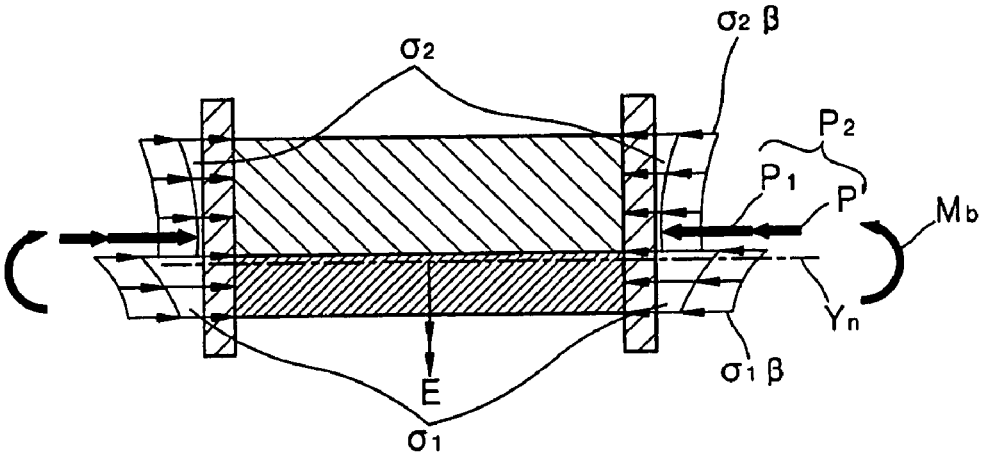
Figure 9:
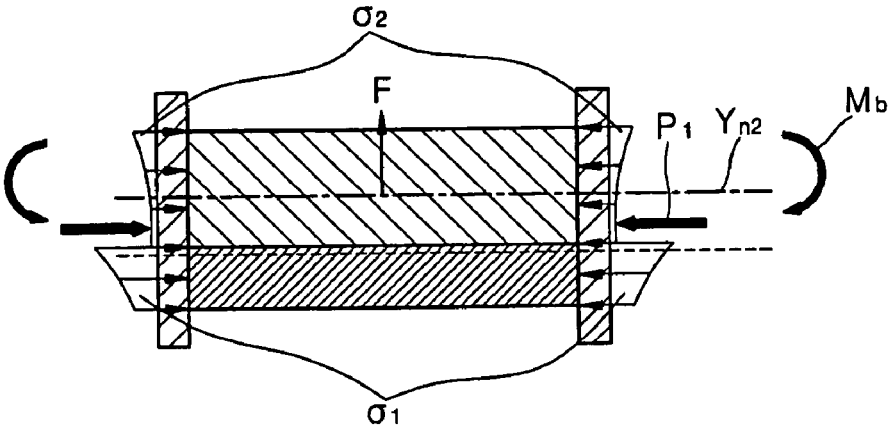

FIG. 5 illustrates the relation between the stress and the transformation of the microactuator according to an embodiment of the present invention. FIG. 6 is a graphical representation of the transformation direction versus the transformation amount according to time of the microactuator shown in FIG. 3. FIGS. 7 through 9 illustrate the relationship between the stress and the bending moment of the microactuator according to each time period shown in FIG. 6.

Figure 10:
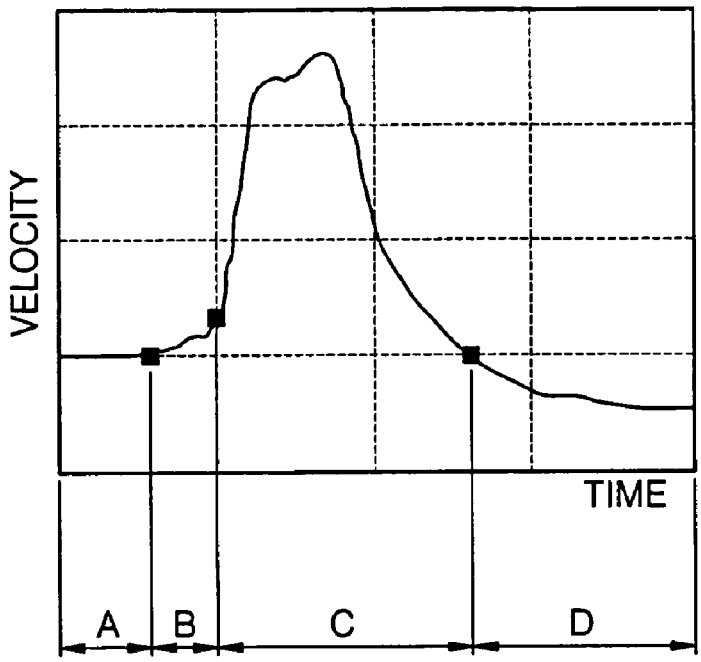
FIG. 10 is a graphical representation of the transformation direction versus the transformation amount according to the time of the microactuator shown in FIG. 4.
Figure 11:
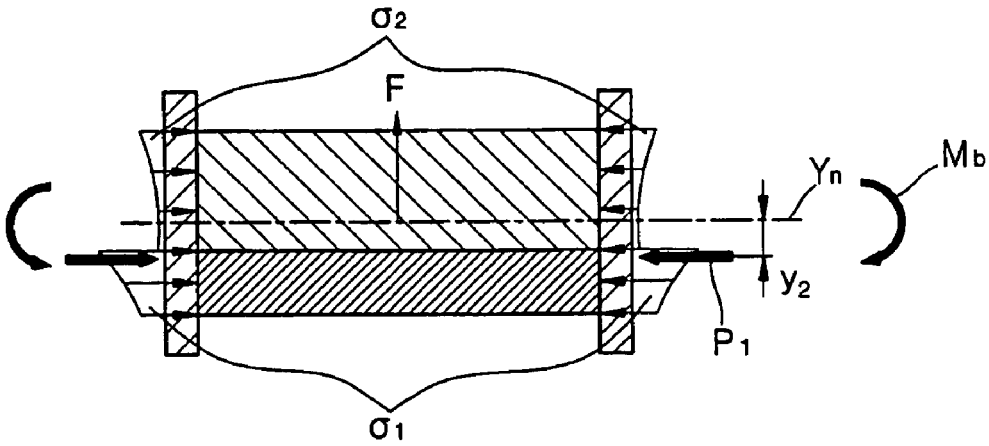
FIGS. 11 through 13 illustrate the relationship between the stress and the bending moment of the microactuator according to each time period shown in FIG. 11.

FIG. 10 is a graphical representation of the transformation direction versus the transformation amount according to the time of the microactuator shown in FIG. 4, and FIGS. 11 through 13 illustrate the relationship between the stress and the bending moment of the microactuator according to each time period shown in FIG. 11.

Referring to FIG. 5, the dynamic relationship of the stress and the transformation of the vibration plate of the microactuator shown in FIGS. 3 and 4 is mechanically idealized as a fixed-fixed beam to indicate the dynamic relation thereof.

Both ends of the vibration plate 130 comprising the first thin film 110 and the second thin film 120 are fixed to the substrate 100. Based on a lower surface of the first thin film 110, an upper portion of the first thin film 110 is defined as a plus Y (+Y) direction, and a lower portion thereof is defined as a minus Y (−Y) direction.

Referring to FIGS. 6 through 10, in FIG. 6, the vibration plate 130 is heated to raise the temperature. As time passes, in a section B, the vibration plate 130 is transformed in the minus Y (−Y) direction, in a section C, the vibration plate 130 is transformed in the plus Y (+Y) direction, and in a section D, the vibration plate 130 is cooled down and returns to its original shape.

FIG. 7 illustrates the dynamic relationship between the stress and the bending moment of the vibration plate 130 in the section A shown in FIG. 6. Referring to FIG. 7, when the vibration plate 130 is in a room temperature state, residual stresses existing in the first thin film 110 and the second thin film 120 act on both ends of the first thin film 110 and the second thin film 120, that is, as a compressive stress $\sigma_1$ on the first thin film 110 and as a compressive stress $\sigma_2$ on the second thin film 120. In this case, both compressive loads $\sigma_1$ and $\sigma_2$ may be indicated as one concentration load $P_1$.

In this case, a neutral axis $Y_n$ exists in which a neutral plane in which transformation with respect to an external load does not occur and may be obtained using Equation 1.

$$Y_n = \frac{E_1 \frac{(h_1 + h_2)^2}{2} + E_2 \frac{(h_2)^2}{2}}{(E_1 \times h_1) + (E_2 \times h_2)} \tag{1}$$

Here, $E_1$ and $E_2$ are Young's moduli of the first thin film 110 and the second thin film 120, and $h_1$ and $h_2$ are the height of the first thin film 110 and the height of the second thin film 120. Thus, the concentration load $P_1$ acts on both ends of the first thin film 110, the second thin film 120, being spaced $y_1$ in an upper direction apart from the neutral axis $Y_n$, and thus, a bending moment $M_b$ with respect to the neutral axis $Y_n$ occurs. Due to the bending moment $M_b$, the vibration plate 130 is transformed in the direction of arrow E.

FIG. 8 illustrates the dynamic relationship between the stress and the bending moment of the vibration plate 130 in the section B shown in FIG. 6. Referring to FIG. 8, the first thin film 110 and the second thin film 120 are heated by the specific resistance generated from an external heat source or an externally-transferred current to raise the temperature by their thermal expansion coefficients. Since both ends of the first thin film 110 and the second thin film 120 are fixed to the substrate 100, additional compressive stresses $\sigma_1\beta$ and $\sigma_2\beta$ act on the first thin film 110 and the second thin film 120, respectively. Both compressive loads $\sigma_1\beta$ and $\sigma_2\beta$ may indicate that one additional compressive load P' acts on the first thin film 110 and the second thin film 120. In this case, $P_2$ may be indicated by a sum of the concentration load $P_1$ acting at room temperature and the additional compressive load P', which is caused by a thermal expansion coefficient.

In this case, the neutral axis $Y_n$ is not varied. Thus, due to the concentration load $P_2$, the bending moment $M_b$ increases, and the vibration plate 130 is additionally transformed in the direction of arrow E.

FIG. 9 illustrates the dynamic relationship between the stress and the bending moment of the vibration plate 130 in the section C shown in FIG. 6. Referring to FIG. 9, the second thin film 120 is heated by the specific resistance generated from an external heat source or an externally-transferred current to raise the temperature and is additionally transformed due to thermal expansion. As the phase transformation of the second thin film 120 is performed frequently, the phase thereof is transformed from martensite to austenite.

In this case, the Young's modulus of the second thin film 120 is increased from the value of martensite to the value of austenite due to phase transformation. Due to the increased Young's modulus, the neutral axis $Y_n$ moves to a second neutral axis $Y_{n2}$ in the plus Y (+Y) direction, as shown in Equation 1.

In this case, the concentration load $P_1$, caused by the compressive stresses $\sigma_1$ and $\sigma_2$, acts on the positions of the first thin film 110 and the second thin film 120, as shown in FIG. 7. Thus, based on the second neutral axis $Y_{n2}$, the bending moment $M_b$ acts on the vibration plate 130 in a direction opposite to the direction shown in FIG. 7. As such, the vibration plate 130 is transformed in the direction of arrow F.

In a section D shown in FIG. 6, if the temperature increase of the vibration plate 130 stops or the vibration plate 130 starts to cool down due to stress reduction caused by thermal expansion, the transformation of the vibration plate 130 is gradually reduced to a state wherein the second thin film 120 is maintained in an austenite phase state. If the second thin film 120 returns to the martensite phase, the vibration plate 130 returns to its original shape, as shown in FIG. 7.

Referring to FIGS. 10 through 13, in FIG. 10, the vibration plate 130 is heated to raise the temperature. Gradually, in a section B, the vibration plate 130 is transformed in a plus Y (+Y) direction, in a section C, the vibration plate 130 is further transformed in the plus Y (+Y) direction, and in a section D, the vibration plate 130 is cooled down and returns to its original shape.

FIG. 11 illustrates the dynamic relationship between the stress and the bending moment of the vibration plate 130 in the section A, as shown in FIG. 10. Referring to FIG. 11, when the vibration plate 130 is in a room temperature state, residual stresses existing in the first thin film 110 and the second thin film 120 act on both ends of the first thin film 110 and the second thin film 120, that is, as a compressive stress $\sigma_1$ on the first thin film 110 and as a compressive stress $\sigma_2$ on the second thin film 120. In this case, both compressive loads $\sigma_1$ and $\sigma_2$ may be indicated as one concentration load $P_1$.

In this case, a neutral axis $Y_n$ exists in which a neutral plane in which transformation with respect to an external load does not occur may be obtained using Equation 1.

Thus, the concentration load $P_1$ acts on both ends of the first thin film 110 and the second thin film 120, being spaced $y_2$ in an upper direction apart from the neutral axis $Y_n$, so that a bending moment $M_b$ with respect to the neutral axis $Y_n$ occurs. Due to the bending moment $M_b$, the vibration plate 130 is transformed in the direction of arrow F.

Figure 12:
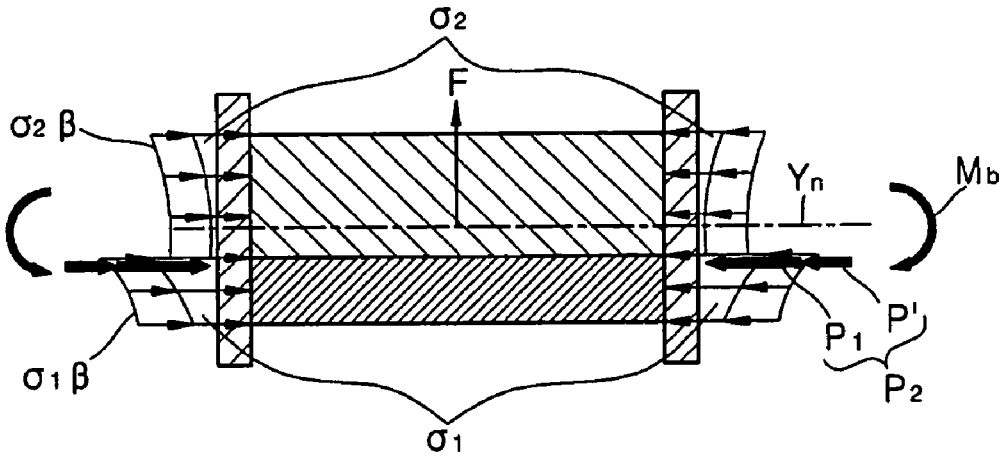

FIG. 12 illustrates the dynamic relationship between the stress and the bending moment of the vibration plate 130 in the section B, as shown in FIG. 10. Referring to FIG. 12, the first thin film 110 and the second thin film 120 are heated by the specific resistance generated from an external heat source or an externally-transferred current to raise the temperature by their thermal expansion coefficients. Since both ends of the first thin film 110 and the second thin film 120 are fixed to the substrate 100, additional compressive stresses $\sigma_1\beta$ and $\sigma_2\beta$ act on the first thin film 110 and the second thin film 120, respectively. Both compressive loads $\sigma_1\beta$ and $\sigma_2\beta$ may indicate that one additional compressive load P' acts on the first thin film 110 and the second thin film 120. In this case, $P_2$ may be indicated by a sum of the concentration load $P_1$, acting at room temperature, and the additional compressive load P', caused by a thermal expansion coefficient.

In this case, the neutral axis $Y_n$ is not varied. Thus, due to the concentration load $P_2$, the bending moment Mb increases, and the vibration plate 130 is additionally transformed in the direction of arrow F.

Figure 13:
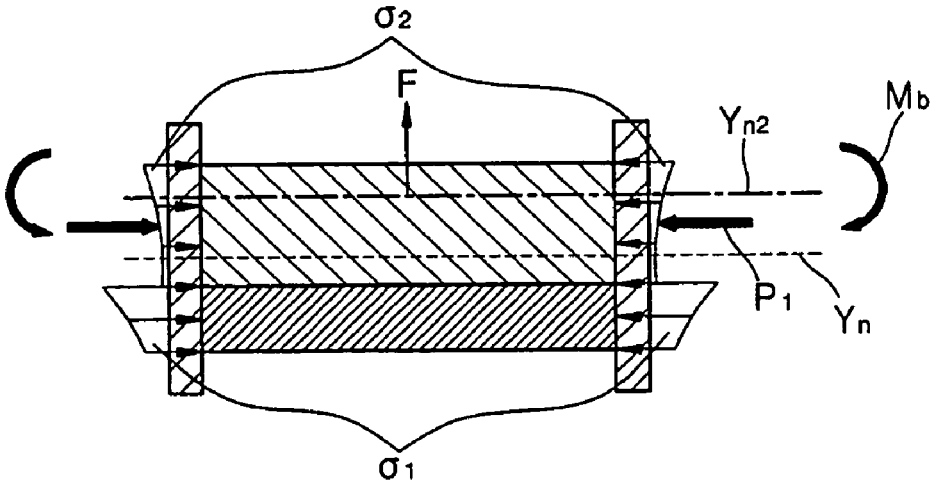

FIG. 13 illustrates the dynamic relationship between the stress and the bending moment of the vibration plate 130 in the section C shown in FIG. 10. Referring to FIG. 13, the second thin film 120 is heated by the specific resistance that is generated from an external heat source or an externally-transferred current to raise the temperature and is additionally transformed due to thermal expansion. Since the phase transformation of the second thin film 120 is performed frequently, the phase thereof is transformed from martensite to austenite.

In this case, the Young's modulus of the second thin film 120 is increased from the value of martensite to the value of austenite due to the phase transformation. Due to the increased Young's modulus, the neutral axis $Y_n$ further moves to a second neutral axis $Y_{n2}$ in the plus Y (+Y) direction, as shown in Equation 1. As such, the vibration plate 130 is further transformed in the direction of arrow F.

In a section D shown in FIG. 10, if the temperature increase of the vibration plate 130 stops or the vibration plate 130 starts to cool down, due to stress reduction caused by thermal expansion, the transformation of the vibration plate 130 is gradually reduced to a state where the second thin film 120 is maintained in an austenite phase state. If the second thin film 120 returns to the martensite phase, the vibration plate 130 returns to its original shape shown in FIG. 10.

Figure 14:
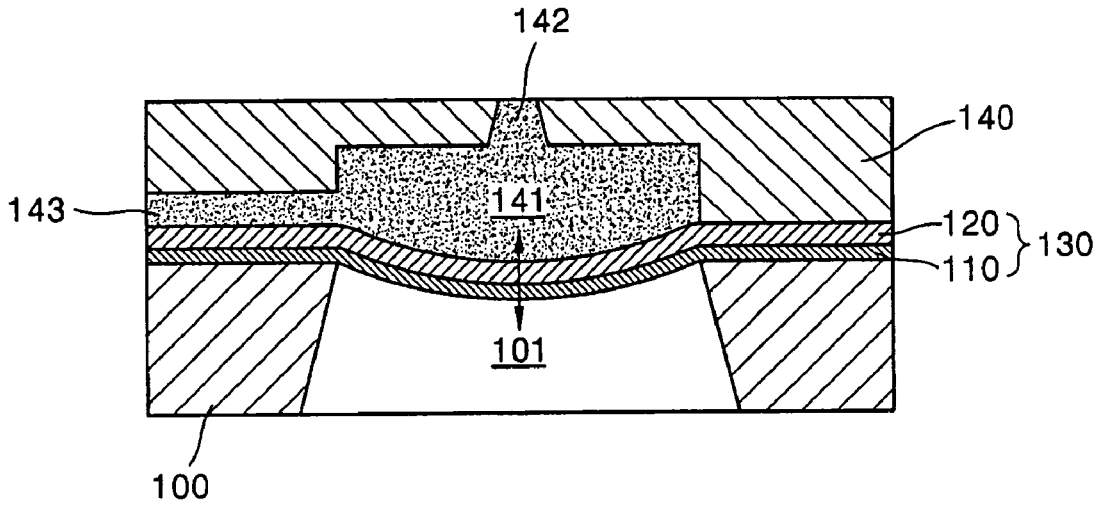
FIG. 14 is a cross-sectional view of an ink-jet printhead using the microactuator according to an embodiment of the present invention.

FIG. 14 is a cross-sectional view of an ink-jet printhead using the microactuator according to an embodiment of the present invention. Referring to FIG. 14, the ink-jet printhead includes a substrate 100 in which a space portion 101 is formed, an ink chamber 141 which is installed on the substrate 100 and in which ink is stored, a nozzle 142 which is installed on an upper portion of the ink chamber 141 and through which ink is ejected, a nozzle plate 140 where a supply hole 143 through which ink is supplied is provided at one side of the nozzle plate 140, and a vibration plate 130 comprising a first thin film 110, which is disposed between the substrate 100 and the nozzle plate 140 and contacts a top surface of the space portion 101, and a second thin film 120 which is formed on the first thin film 110 to contact the ink chamber 141 and is formed of a shape memory alloy layer.

While the vibration plate 130 moves in a predetermined direction, the volume of the ink chamber 141 is varied. Ink is ejected through the nozzle 142 to the outside of the chamber using a pressure variation caused by the variation in volume of the ink chamber 141.

Figure 15A:
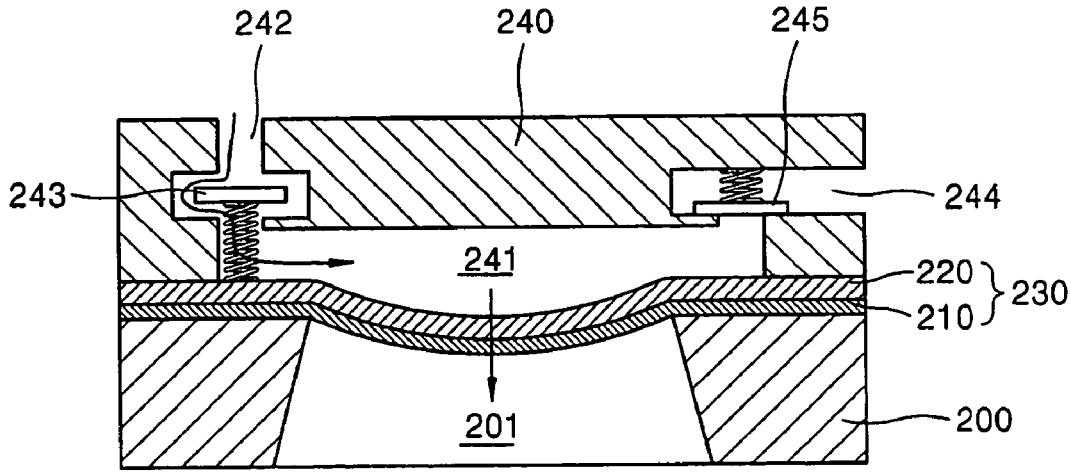
FIGS. 15A and 15B are cross-sectional views illustrating the operation of a fluid transfer apparatus using the microactuator according to an embodiment of the present invention.
Figure 15B:
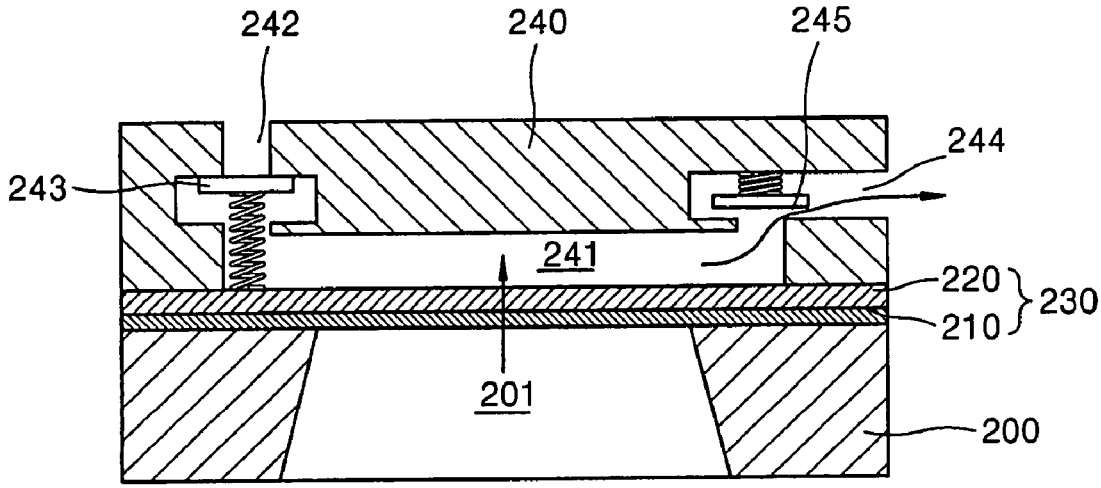

FIGS. 15A and 15B are cross-sectional views illustrating the operation of a fluid transfer apparatus using the microactuator according to an embodiment of the present invention. Referring to FIGS. 15A and 15B, the fluid transfer apparatus includes a substrate 200 in which a space portion 201 is formed, a passage plate 240 having a chamber 241 installed on the substrate 200 and in which fluid is temporarily stored, a supply hole 242 through which fluid is supplied to the chamber 241 at one side of the passage plate 240 and an exhaust hole 244 through which fluid is exhausted from the chamber 241 at the other side of the passage plate 240, and a vibration plate 230 which is provided between the substrate 200 and the passage plate 240 and generates a pressure required to transfer fluid by varying the volume of the chamber 241.

The vibration plate 230 includes a first thin film 210 formed of a silicon substrate ($SiO_2$) to cover an upper portion of the space portion 201 and a second thin film 220 contacting the chamber 241, which is formed of a shape memory alloy layer of which a phase is varied according to a temperature variation.

A first valve 243, which regulates fluid to flow only into the chamber 241, is installed in the supply hole 242. A second valve 245, which regulates fluid to flow only from the chamber 241 into the exhaust hole 244, is installed in the exhaust hole 244.

The operation of the fluid transfer apparatus having the above structure will be described with reference to FIGS. 15A and 15B.

Referring to FIG. 15A, while the vibration plate 230 is transformed toward the space portion 201, the volume of the chamber 241 is increased temporarily. In this case, the first valve 243 opens the supply hole 242 so that fluid flows into the chamber 241, and the second valve 245 closes the exhaust hole 244 so that fluid flows into the chamber 241.

Referring to FIG. 15B, while the vibration plate 230 is transformed toward the chamber 241 and is flattened, the volume of the chamber 241 is reduced. In this case, the first valve 243 closes the supply hole 242 so that fluid does not flow into the chamber 241, and the second valve 245 opens the exhaust hole 244 so that fluid flows out from the chamber 241.

By repeating the above operation, fluid is transferred via the fluid transfer apparatus.

As described above, the microactuator using a shape memory alloy according to the present invention has, among others, the following advantages.

First, regarding the dimension, the matter property and the residual stress of a first thin film and a second thin film used to form a vibration plate of the microactuator can be selected so that the initial transformation of the vibration plate is intended, and thus, a desired operation may be performed. Second, a transformation characteristic with respect to the stress of the vibration plate is obtained, such that a signal applied to drive the vibration plate is adjusted, and the kinetic efficiency of a composite thin film with respect to an input driving signal is increased due to the increased kinetic efficiency. Heat applied to the composite thin film and a peripheral member is minimized, and the operating frequency of the composite thin film may be increased. Third, the width of the microactuator is smaller than that of a conventional microactuator using a shape memory alloy, such that the arrangement density of the actuator may be increased.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A microactuator using shape memory alloy, the microactuator comprising:

a substrate in which a space portion is formed; and a vibration plate which is installed on an upper surface of the substrate to cover the space portion, including a first thin film formed of a shape memory alloy and at least a second thin film on which a compressive residual stress acts, wherein the vibration plate is initially transformed to bend to the space portion or to bend to be opposite to the space portion due to a bending moment caused by the compressive residual stress with respect to a first neutral axis, wherein, when the shape memory alloy is phase-transformed due to a rise in temperature, the vibration plate is transformed to bend to the space portion or to bend to be opposite to the space portion due to a bending moment occurring with respect to a second neutral axis that moves from the first neutral axis, and the vibration plate varies the area of a chamber in which fluid is stored, providing pressure to the fluid, and wherein the vibration plate comprises:

the first thin film which is formed on the upper surface of the substrate and is formed of a silicon substrate to cover the upper portion of the space portion; and the second thin film which is formed on the upper surface of the first thin film and of which phase is varied according to a temperature variation.

2. The microactuator of claim 1, wherein, when a width of the vibration plate contacting the space portion is W, the thickness of the first thin film is $t_1$ and the thickness of the second thin film is $t_2$, the width w of the vibration plate is equal to or less than approximately 100 μm, and the ratio of the thickness $t_1$ of the first thin film to the thickness $t_2$ of the second thin film is equal to or less than approximately 1:2.5 that the vibration plate selectively bends to the space portion or to be opposite to the space portion.

3. The microactuator of claim 2, wherein the width w of the vibration plate is less than 85 μm, and the ratio of the thickness $t_1$ of the first thin film to the thickness $t_2$ of the second thin film is equal to or less than approximately 1:2 so that the vibration plate bends to the space portion.

4. The microactuator of claim 3, wherein the thickness $t_2$ of the second thin film is equal to or less than approximately 2.1 μm.

5. A microactuator using shape memory alloy, the microactuator comprising:

a substrate in which a space portion is formed; and a vibration plate which is installed on an upper surface of the substrate to cover the space portion, including a first thin film formed of a shape memory alloy and at least a second thin film on which a compressive residual stress acts, wherein the vibration plate is initially transformed to bend to the space portion or to bend to be opposite to the space portion due to a bending moment caused by the compressive residual stress with respect to a first neutral axis, wherein, when the shape memory alloy is phase-transformed due to a rise in temperature, the vibration plate is transformed to bend to the space portion or to bend to be opposite to the space portion due to a bending moment occurring with respect to a second neutral axis that moves from the first neutral axis, and the vibration plate varies the volume of a chamber in which fluid is stored, providing pressure to the fluid, wherein the width w of the vibration plate is less than approximately 85 μm, and the ratio of the thickness $t_1$ of the first thin film to the thickness $t_2$ of the second thin film is greater than approximately 1:2, so that the vibration plate bends to be opposite to the space portion.

6. The microactuator of claim 5, wherein the thickness $t_2$ of the second thin film is greater than approximately 2.1 μm.

7. The microactuator of claim 2, wherein, when the length of the vibration plate contacting the upper surface of the space portion is l, the ratio of the width w to the length l of the vibration plate is equal to or greater than approximately 1:3.

8. A fluid transfer apparatus comprising:

a substrate in which a space portion is formed;

a passage plate wherein a chamber which is installed on the substrate and in which fluid is temporarily stored, having a supply hole through which fluid is supplied to the chamber at one side of the passage plate and having an exhaust hole through which fluid is exhausted from the chamber at the other side of the passage plate; and a vibration plate between the substrate and the passage plate, that generates a pressure required to transfer fluid by varying a volume of the chamber, installed on an upper surface of the substrate to cover the space portion and having a first thin film formed of a shape memory alloy and at least a second thin film on which a compressive residual stress acts, wherein the vibration plate is initially transformed to bend to the space portion or to bend to be opposite to the space portion due to a bending moment caused by compressive residual stress with respect to a first neutral axis, when the shape memory alloy is phase-transformed due to temperature rise, the vibration plate is transformed to bend to a space portion or to bend to be opposite to the space portion due to a bending moment occurring with respect to a second neutral axis that moves from the first neutral axis, and the vibration plate varies an area of a chamber in which fluid is stored, providing pressure to the fluid, wherein a first valve which regulates fluid to flow only into the chamber, is installed in the supply hole, and a second valve which regulates fluid to flow only from the chamber into the exhaust hole, is installed in the exhaust hole.

9. The apparatus of claim 8, wherein the vibration plate includes the first thin film which is formed on the upper surface of the substrate and is formed of a silicon substrate to cover a upper portion of the space portion and the second thin film which is formed on the upper surface of the first thin film and of which phase is varied according to a temperature variation, and when a width of the vibration plate contacting the space portion is W, a thickness of the first thin film is $t_1$ and a thickness of the second thin film is $t_2$, a width w of the vibration plate is equal to or less than approximately 100 μm, and a ratio of the thickness $t_1$ of the first thin film to the thickness $t_2$ of the second thin film is equal to or less than approximately 1:2.5 so that the vibration plate selectively bends to the space portion or to be opposite to the space portion.

10. The apparatus of claim 9, wherein the width w of the vibration plate is less than 85 μm, and the ratio of the thickness $t_1$ of the first thin film to the thickness $t_2$ of the second thin film is equal to or less than approximately 1:2, so that the vibration plate bends to the space portion.

11. The apparatus of claim 10, wherein the thickness $t_2$ of the second thin film is equal to or less than approximately 2.1 μm.

12. The apparatus of claim 9, wherein the width w of the vibration plate is less than 85 μm, and the ratio of the thickness $t_1$ of the first thin film to the thickness $t_2$ of the second thin film is greater than approximately 1:2, so that the vibration plate bends to the ink chamber.

13. The apparatus of claim 12, wherein the thickness $t_2$ of the second thin film is greater than approximately 2.1 μm.

14. The apparatus of claim 9, wherein, when the length of the vibration plate installed on the substrate is l, and the ratio of the width w to the length l of the vibration plate is equal to or greater than approximately 1:3.

15. An ink-jet printhead comprising:

a microactuator having a vibration plate comprising a first thin film formed of a shape memory alloy and at least a second thin film on which a compressive residual stress acts, wherein the vibration plate has bending moments about two different axes; and a substrate having a space portion formed therein;

the vibration plate being installed on an upper surface of the substrate to cover the space portion, wherein the shape memory alloy comprises a second thin film, and the first thin film is compressible by a compressive residual stress, wherein the vibration plate is transformable to bend to the space portion or to bend to be opposite to the space portion, with respect to a first neutral axis, due to a bending moment caused by the compressive residual stress, wherein the shape memory alloy is phase-transformable in accordance with a temperature rise of the vibration plate, bending to the space portion or to be opposite to the space portion due to a bending moment occurring with respect to a second neutral axis that moves from the first neutral axis, to vary an area of a chamber in which fluid is stored and provide pressure to the fluid, and wherein, when a width of the vibration plate contacting the space portion is W, the thickness of the first thin film is $t_1$ and the thickness of the second thin film is $t_2$, the width w of the vibration plate is equal to or less than approximately 100 μm, and the ratio of the thickness $t_1$ of the first thin film to the thickness $t_2$ of the second thin film is equal to or less than approximately 1:2.5 so that the vibration plate selectively bends to the space portion or to be opposite to the space portion.

16. A microactuator utilizing a shape memory alloy, the microactuator comprising:

a substrate having a space portion formed therein; and a temperature dependent vibration plate on an upper surface of the substrate, covering the space portion, wherein the temperature dependent vibration plate has at least a first thin film formed of the shape memory alloy and at least a second thin film formed on the first thin film and compressible by residual stress and bendable in accordance with two predetermined axes, wherein the first thin film is formed on the upper surface of the substrate and is formed of a silicon substrate to cover an upper portion of the space portion, the second thin film is formed on an upper surface of the first thin film and has a phase that is varied according to a temperature variation, and a compressive residual stress acts on the second thin film in accordance with the temperature variation, and wherein, when a width of the vibration plate contacting the space portion is W, the thickness of the first thin film is $t_1$ and the thickness of the second thin film is $t_2$, the width w of the vibration plate is equal to or less than approximately 100 μm, and the ratio of the thickness $t_1$ of the first thin film to the thickness $t_2$ of the second thin film is equal to or less than approximately 1:2.5 so that the vibration plate selectively bends to the space portion or to be opposite to the space portion.

17. The microactuator of claim 16, wherein the width w of the vibration plate is less than 85 μm, and the ratio of the thickness $t_1$ of the first thin film to the thickness $t_2$ of the second thin film is equal to or less than approximately 1:2 so that the vibration plate bends to the space portion.

18. The microactuator of claim 17, wherein the thickness $t_2$ of the second thin film is equal to or less than approximately 2.1 μm.

19. A microactuator utilizing a shape memory alloy, the microactuator comprising:

a substrate having a space portion formed therein; and a temperature dependent vibration plate on an upper surface of the substrate, covering the space portion, wherein the temperature dependent vibration plate has at least a first thin film formed of the shape memory alloy and at least a second thin film formed on the first thin film and compressible by residual stress and bendable in accordance with two predetermined axes, wherein the first thin film is formed on the upper surface of the substrate and is formed of a silicon substrate to cover an upper portion of the space portion, the second thin film is formed on an upper surface of the first thin film and has a phase that is varied according to a temperature variation, and a compressive residual stress acts on the second thin film in accordance with the temperature variation, and wherein, when the width w of the vibration plate is less than 85 μm, and the ratio of the thickness $t_1$ of the first thin film to the thickness $t_2$ of the second thin film is greater than approximately 1:2, the vibration plate bends to be opposite to the space portion.

20. The microactuator of claim 19, wherein the thickness $t_2$ of the second thin film is greater than approximately 2.1 μm.

21. A microactuator utilizing a shape memory alloy, the microactuator comprising:

a substrate having a space portion formed therein; and a temperature dependent vibration plate on an upper surface of the substrate, covering the space portion, wherein the temperature dependent vibration plate has at least a first thin film formed of the shape memory alloy and at least a second thin film formed on the first thin film and compressible by residual stress and bendable in accordance with two predetermined axes, wherein the first thin film is formed on the upper surface of the substrate and is formed of a silicon substrate to cover an upper portion of the space portion, the second thin film is formed on an upper surface of the first thin film and has a phase that is varied according to a temperature variation, and a compressive residual stress acts on the second thin film in accordance with the temperature variation, and wherein, when the length of the vibration plate contacting the upper surface of the space portion is l, the ratio of the width w to the length l of the vibration plate is equal to or greater than approximately 1:3.

22. A microactuator using shape memory alloy, the microactuator comprising:

a substrate in which a space portion is formed; and a vibration plate which is installed on an upper surface of the substrate to cover the space portion, wherein the vibration plate comprises:

a first thin film formed of a shape memory alloy, which is phase-transformed due to a temperature variation, on the upper surface of the substrate to cover an upper portion of the space portion; and at least a second thin film, on which a compressive residual stress acts, is formed on the upper surface of the first thin film, wherein, when a width of the vibration plate contacting the space portion is W, the thickness of the first thin film is $t_1$ and the thickness of the second thin film is $t_2$, the width w of the vibration plate is equal to or less than approximately 100 μm, and the ratio of the thickness $t_1$ of the first thin film to the thickness $t_2$ of the second thin film is equal to or less than approximately 1:2.5 so that the vibration plate selectively bends to the space portion or to be opposite to the space portion, providing pressure to a fluid.

* * * * *

UNITED STATES PATENT AND TRADEMARK OFFICE

CERTIFICATE OF CORRECTION

PATENT NO. : 7,128,403 B2
APPLICATION NO. : 10/862317
DATED : October 31, 2006
INVENTOR(S) : Myung-song Jung It is certified that error appears in the above-identified patent and that said Letters Patent is hereby corrected as shown below:

Column 10, Line 44, after "1:2.5" insert --so--.

Signed and Sealed this

Sixth Day of March, 2007

JON W. DUDAS
*Director of the United States Patent and Trademark Office*